US010370228B2

(12) United States Patent
Cazzaro

(10) Patent No.: US 10,370,228 B2
(45) **Date of Patent: *Aug. 6, 2019**

(54) WINCH PROVIDED WITH ADJUSTABLE SELF-TAILING AND RELATIVE OPERATION

(71) Applicant: HARKEN ITALY S.P.A., Limido Comasco (IT)

(72) Inventor: Michele Cazzaro, Besozzo (IT)

(73) Assignee: HARKEN ITALY S.P.A., Limido Comasco (Como) (IT)

( * ) Notice: Subject to any disclaimer, the term of this patent is extended or adjusted under 35 U.S.C. 154(b) by 0 days.

This patent is subject to a terminal disclaimer.

(21) Appl. No.: 15/908,494

(22) Filed: Feb. 28, 2018

(65) Prior Publication Data

US 2018/0186609 A1 Jul. 5, 2018

Related U.S. Application Data

(63) Continuation of application No. 13/823,678, filed as application No. PCT/IT2010/000395 on Sep. 17, 2010, now Pat. No. 9,938,122.

(51) Int. Cl.
*B66D 1/74* (2006.01)

(52) U.S. Cl.
CPC ..... *B66D 1/7494* (2013.01); *B66D 1/7436* (2013.01)

(58) Field of Classification Search
CPC ... B66D 1/7494; B66D 1/7436; B66D 1/7431
See application file for complete search history.

(56) References Cited

U.S. PATENT DOCUMENTS 463,719 A * 11/1891 Hart ..... B66D 1/14 254/288
3,927,580 A * 12/1975 Fawcett ..... B66D 1/7431 224/901

(Continued)

FOREIGN PATENT DOCUMENTS

CN 201010479 Y 1/2008
CN 201473251 U 5/2010

(Continued)

OTHER PUBLICATIONS

International Preliminary Report on Patentability issued for International Patent Application No. PCT/IT2010/000395, filed Sep. 17, 2010 on behalf of Harken Italy S.P.A. dated Mar. 19, 2013. 8 pages (Continued)

*Primary Examiner* — Michael E Gallion
(74) *Attorney, Agent, or Firm* — Steinfl + Bruno LLP

(57) ABSTRACT

The invention describes a winch for nautical use or for devices for lifting and lowering on a rope, comprising a fixed stator body and a rotor body fixedly connected to the stator body. The rotor body is able to rotate around a longitudinal axis to wind a rope on its outer surface. The winch is provided with a self-tailing device in turn comprising two half-pulleys, a lower half-pulley and an upper half-pulley, mounted opposite one another and coaxial to the rotor body. The two half-pulleys, at the upper portion of the outer surface of the rotor body, define a circumferential throat intended to at least partially house a winding of the rope. One half-pulley is fixed with respect to the rotor body and the other half-pulley is moveable parallel to the longitudinal axis to vary the dimensions of the circumferential throat. Advantageously, the winch comprises a device for adjusting the position of the mobile half-pulley along the longitudinal axis; the adjustment device is able to be acti- (Continued)

vated by the user in real time and in all conditions of use of the winch.

16 Claims, 6 Drawing Sheets

(56) References Cited

U.S. PATENT DOCUMENTS 3,968,953 A * 7/1976 Guangorena ..... B66D 1/7431 254/342
3,985,340 A * 10/1976 Guangorena ..... B66D 1/7431 254/344
4,120,486 A * 10/1978 Mehnert ..... B66D 1/7415 192/18 R
4,225,118 A * 9/1980 Ottemann ..... B66D 1/7431 254/333
4,341,372 A * 7/1982 Sugioka ..... B66D 1/7494 254/353
4,453,701 A * 6/1984 Huggett ..... B66D 1/7494 254/371
4,815,710 A * 3/1989 Bonassi ..... B66D 1/7421 254/371
4,974,814 A * 12/1990 Cundy ..... B66D 1/24 254/342
6,047,955 A * 4/2000 Cavanagh ..... B66D 1/7431 254/371
6,431,103 B1 * 8/2002 Meyerdierks ..... B63B 21/16 114/218
7,055,805 B1 * 6/2006 Leitch ..... B66D 1/7421 254/371
8,820,720 B2 * 9/2014 Fields ..... B66D 1/7484 254/371
9,938,122 B2 * 4/2018 Cazzaro ..... B66D 1/7436
2003/0213945 A1 * 11/2003 Vado ..... B66D 1/7436 254/339
2010/0032509 A1 * 2/2010 Cazzaro ..... B66D 1/38 242/397.3
2012/0145981 A1 * 6/2012 Ryberg ..... B66D 1/7426 254/371
2014/0145130 A1 * 5/2014 Cazzaro ..... B66D 1/7436 254/371

FOREIGN PATENT DOCUMENTS

EP 0066936 A2 12/1982
EP 0745554 A1 12/1996

OTHER PUBLICATIONS

Written Opinion issued for International Patent Application No. PCT/IT2010/000395, filed Sep. 17, 2010 on behalf of Harken Italy S.P.A. dated Jun. 24, 2011. 7 pages.

* cited by examiner

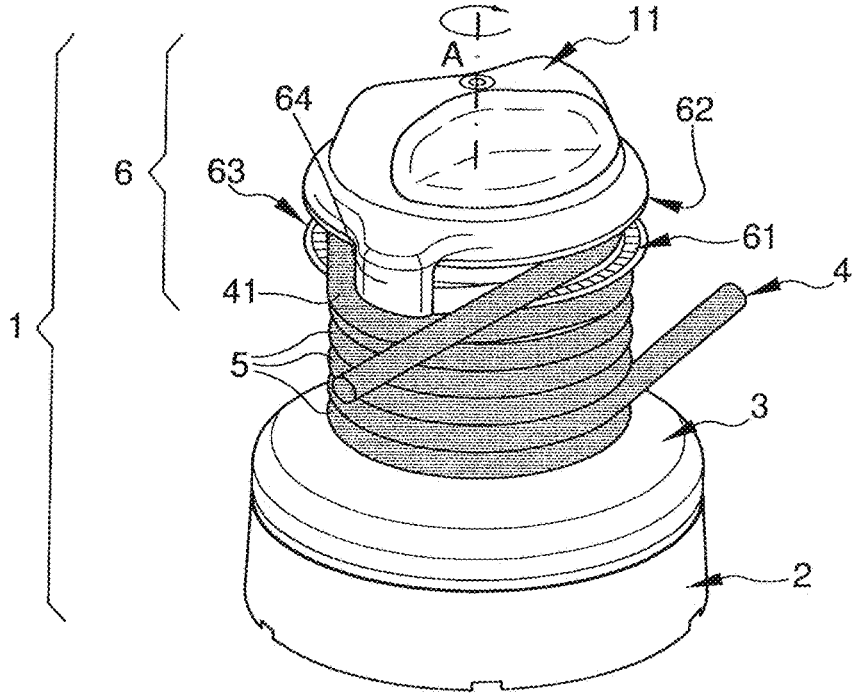
Fig. 1
Fig. 2
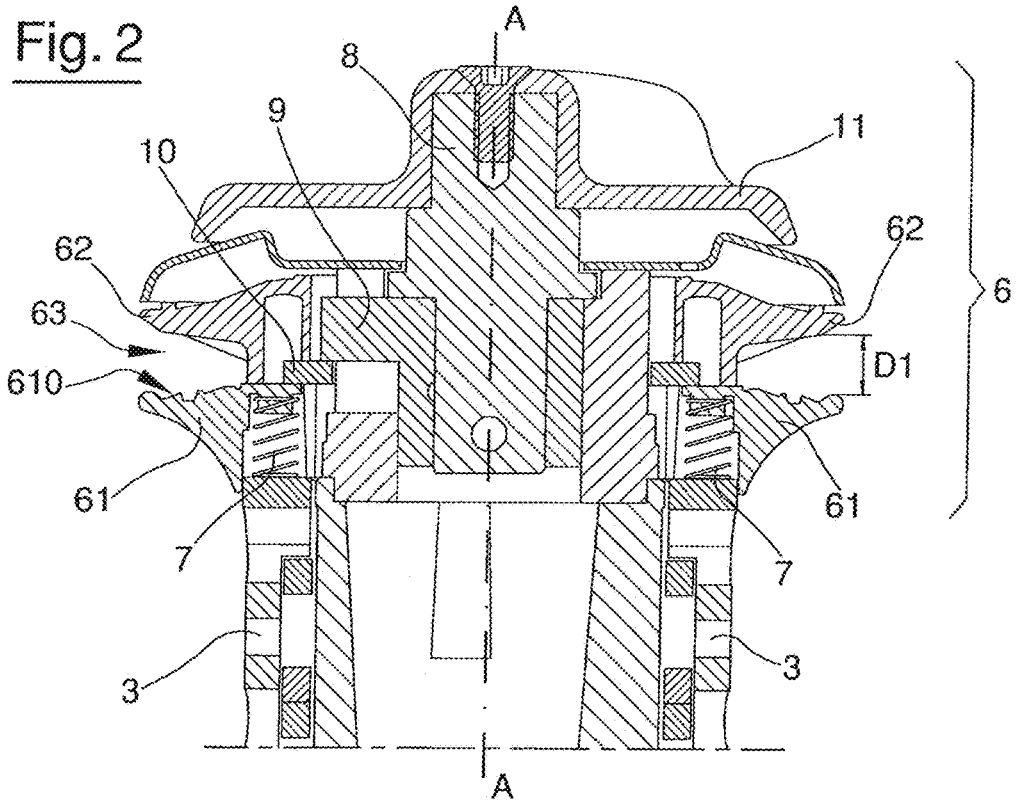

WINCH PROVIDED WITH ADJUSTABLE SELF-TAILING AND RELATIVE OPERATION

CROSS REFERENCE TO RELATED APPLICATIONS

The present application is a continuation application of U.S. application Ser. No. 13/823,678 filed on Oct. 21, 2013 which is the U.S. national stage of International Application PCT/IT2010/000395 filed on Sep. 17, 2010, the contents of each are incorporated herein by reference in their entirety.

FIELD OF THE INVENTION

The present invention refers to a nautical winch, particularly suitable for use on sailing boats and also in devices for lifting and lowering on a rope, provided with an adjustable self-tailing device.

PRIOR ART

As known, nautical winches are used in sailing boats to facilitate the manoeuvring and adjustment of the sails, like for example the operations of positioning and hoisting there. Such operations are carried out with force, by manoeuvring suitable cables or ropes under tension (normally indicated with the terms: sheets or halyards) connected to the sails; the ropes, in particular, are collected (hauled) and released (surged) by winding and unwinding them on and from suitable winches positioned on the deck of the boat.

A nautical winch is also used in the device for lifting and lowering on a rope described in international patent application Ser. No. PCT/IB2010/001313 to the Applicant.

Nautical winches essentially comprise a stator body, or support, intended to be fixed to the deck of the boat and a rotor body, or winding drum, rotatably associated with the stator body and intended to receive the windings of the rope during the relative hauling operations.

The rotor body is fitted coaxially on the stator body along a longitudinal shaft of the latter and it is free to rotate with respect to the stator body in a first direction of rotation (for example clockwise), so as to wind the rope on the rotor body, with it being locked, on the other hand, in the opposite direction of rotation.

The described winches foresee a single manoeuvring speed or, when provided with suitable gears, two distinct manoeuvring speeds. In this last case the lower speed corresponds to a greater pulling force applied to the rope.

There are also reversible winches, usually motorised, in which the rotor, body, i.e. the winding drum, can rotate in the clockwise and anti-clockwise direction with respect to the stator body, according to whether the user must haul or surge the rope under tension. Usually, reversible winches foresee a single manoeuvring speed.

In order to facilitate the operations to collect the manoeuvring rope, which is under tension, and to allow the sail to be kept in the desired position, it is necessary to suitably hold the rope on the winch, so as to prevent it from unwinding.

For this purpose, different devices have been proposed to lock the rope positioned directly on the winch. The most common of these is an self locking device known as self-tailing device.

The self-tailing device comprises two coaxial and opposite half-pulleys, arranged fixedly connected to the rotor body of the winch, which, at the upper portion of the side surface of the winch, define a circumferential throat, typically with a V or U-shaped section, intended to at least partially house a winding of the manoeuvring rope. A possible tension applied to the manoeuvring rope housed in the throat causes a further forced insertion of the rope itself in the throat of the self-tailing device; the two half-pulleys clamp the rope from opposite sides and therefore the self-tailing device acts as a pincer, preventing the rope from sliding with respect to the winch.

Often the surfaces of the two half-pulleys that engage the rope are knurled to maximise the hold of the self-tailing device on the rope itself.

The self-tailing devices are able to completely lock the rope when the winch is still and hold the rope, preventing it from disengaging with respect to the throat, when the winch is set in rotation.

In some embodiments a first half-pulley is fixed with respect to the rotor body of the winch and the second half-pulley, on the other hand, is able to slide slightly in the axial direction with respect to the first half-pulley. A plurality of preloaded springs thrusts the second half-pulley against the first half-pulley to clamp the rope in the throat of the self-tailing device. The axial movement of the second half-pulley, although limited to a few millimeters or at most to one or two centimeters, makes it possible to adapt the dimensions of the throat to the different diameters of the ropes that the user may decide to wind on the winch.

British patent application GB-A-2034661 describes a nautical winch, provided with self-tailing, wherein the upper half-pulley is able to slide axially with respect to the lower half-pulley and it is thrusted towards the latter by a helical spring.

European patent application EP-A-066936 describes a winch provided with a self-tailing device that automatically adjusts the clamping force exerted on the rope when it slides relative to the winding drum of the winch. The lower half-pulley of the self-tailing device is fixed to the winding drum of the winch and rotates as a unit with it; the upper half-pulley is able to move axially to widen or narrow the throat for receiving the rope. The movement of the upper half-pulley is controlled by a cam mechanism. A possible sliding of the rope with respect to the lower half-pulley determines a rotation speed gradient between the two half-pulleys; in this circumstance the cam mechanism intervenes to prevent the relative rotation between the two half-pulleys and, on the other hand, control the axial movement of the upper half-pulley towards the lower one. In this way the clamping force of the self-tailing device is maximised and the sliding of the rope is nullified. The cam mechanism, provided with counteraction springs, tends to bring the self-tailing device back into its initial configuration when the rope stops sliding with respect to the lower half-pulley.

The self-tailing devices described above, whilst being efficient in the manoeuvres to collect the rope, do not however allow the manoeuvres to partially release or completely free the rope from the winch, sometimes suitable to obtain the optimal adjustment of the sails, to be carried out quickly and easily. In order to be able to even just partially unwind the windings of the rope on the drum it is necessary to first free the rope from the throat of the self-tailing device unwinding it for almost one revolution; this operation requires experience from the user and entails some risk, given that the tension applied to the rope can be substantial.

The Applicant has felt the need to provide a winch that, as well as being particularly efficient in the manoeuvres to collect the rope, allowing effective and quick locking of the rope directly on the winch, also allows the operations to partially release or completely free the rope from the winch to be carried out extremely quickly and easily, even when the rope is under tension. The Applicant has become aware of such a requirement particularly with reference to competition sailing boats, where it is necessary for the operations to release the rope to be carried out in the shortest time possible, in order to allow quick passage from one racing trim to another, so as to always keep high speeds and precise trajectories.

SUMMARY OF THE INVENTION

The purpose of the present invention is therefore to provide a winch provided with a self-tailing device, applicable to the nautical field or in devices for lifting and lowering on a rope, which allows the manoeuvres to partially release or completely free the rope from the winch to be carried out simply and effectively even when the rope is under tension, i.e. during manoeuvres under force.

A further purpose of the present invention is therefore to provide a winch of the aforementioned type, which allows the rope to be partially or totally surged from the winch, in a controlled manner, i.e. with the speed desired by the user, without it being necessary to disengage the rope from the self-tailing device.

In a first aspect thereof, the invention therefore concerns a nautical winch according to claim 1.

In particular, the winch comprises:

a) a fixed stator body;

b) a rotor body coupled to the stator body, the rotor body being able to rotate around a longitudinal axis to wind a rope on its outer surface;

c) a self-tailing device in turn comprising two half-pulleys, a lower half-pulley and an upper half-pulley, mounted opposite one another and coaxial to the rotor body, said half-pulleys, at the upper portion of the outer surface of the rotor body, defining a circumferential throat intended to at least partially house a winding of said rope, wherein one half-pulley is fixed with respect to said rotor body and the other half-pulley is moveable parallel to said longitudinal axis to vary the dimensions of said circumferential throat, d) wherein said winch also comprises a device for adjusting the position of the mobile half-pulley along said longitudinal axis, the adjustment device being able to be activated by the user in all conditions of use of the winch.

With reference to the operations to release and completely free the rope, the winch of the present invention has, in addition to the advantages typical of winches provided with a self-tailing device, the further important advantage of allowing the controlled release of the rope even when it is under tension. By acting upon the device for adjusting the position of the mobile half-pulley, the user actively adjusts the dimensions of the circumferential throat in real time, increasing the wheelbase between the two half-pulleys by the maximum length allowed or else by a desired intermediate length; such a wheelbase can be increased to obtain the sliding of the rope with respect to the half-pulleys and the consequent unwinding of the rope under tension from the rotor body of the winch, i.e. from its winding drum.

The procedure of increasing the wheelbase of the half-pulleys is equivalent to "opening" o "widening" the self-tailing device; this case be done for the entire available stroke based on the structure of the winch or only partially. The mobile half-pulley moves along the longitudinal axis from a position proximal to the fixed half-pulley to a position distal with respect to the same fixed half-pulley. The movement is preferably continuous, but it can also be intermittent between predetermined stable intermediate positions.

The operations to release and completely free the rope from the winch are thus facilitated overall and can be advantageously carried out in extremely short times with respect to what it was possible to do with conventional winches, with which, on the other hand, the user is forced to free the rope from the self-tailing device.

The winch according to the present invention makes it possible to release the rope without it being necessary to completely free it from the self-tailing device.

Preferably, at the moment when the user no longer acts upon the device for adjusting the position of the mobile half-pulley, the latter is thrusted automatically towards the fixed half-pulley, to "close up" or "narrow" the self-tailing device on the rope and stop it from unwinding. In other words, preferably the opening of the self-tailing device is temporary and lasts an amount of time set by the user with his intervention.

The winch according to the present invention can be used with the advantages described above also in devices for lifting and lowering on a rope, for example in the device described in international patent application Ser. No. PCT/IB2010/001313 to the Applicant. The temporary opening of the self-tailing device by the user allows the controlled unwinding of the cable from the winding drum of the winch, and thus allows controlled descent along the cable, without it being necessary to disengage the cable from the self-tailing device and from the winding drum even for an instant, with clear advantages in terms of the safety of the operator.

Preferably, the mobile half-pulley is the upper one and the fixed half-pulley is the lower one. Alternatively, the mobile half-pulley is the lower one and the fixed half-pulley is the upper one.

The longitudinal axis to which we refer in the present invention is the axis of rotation of the rotor body of the winch and preferably it coincides with the longitudinal axis of the shaft of the stator body to which the rotor body is fixedly connected.

In an embodiment the winch also comprises one or more thrusting elements of the mobile half-pulley, the function of which is to constantly exert a return force of the same mobile half-pulley towards the fixed half-pulley. In this circumstance the adjustment device comprises means for counteracting the force exerted by the thrusting means and an element for controlling the counteraction means, accessible to the user outside of the winch. Therefore, by acting upon the counteraction means through the relative control means, the user can reduce to nullify the thrusting force exerted on the mobile half-pulley, which moves away from the fixed half-pulley moving along the longitudinal axis of the rotor body. The result of this procedure is the opening of the self-tailing device described above.

Preferably, each of the thrusting elements is a spring, for example helical or leaf-type, preloaded, arranged between the mobile half-pulley and a portion of the winch not able to move along the aforementioned longitudinal axis. The preloading of the springs is preferably selected at the factory, while the winch is being built. If necessary, the springs can be replaced with other springs having a different elastic coefficient to obtain a greater or lesser return force on the mobile half-pulley.

As an alternative to the springs, the thrusting elements can be elements made from resilient material, for example rubber cylinders or cubes.

The number and the position of the thrusting elements, be they springs or elements made from resilient material, are selected based on the requirements of end use of the winch. Clearly, a large number of thrusting elements corresponds to a great return force of the mobile half-pulley on the fixed half-pulley and, vice-versa, a small number of thrusting elements corresponds to a small return force of the mobile half-pulley on the fixed half-pulley.

For example, the winch can be delivered by the manufacturer with a certain number of thrusting elements and with, for example, some seats of the thrusting elements free. The user can modify the number of thrusting elements, by adding some new ones in the free seats or by removing some of the thrusting elements already present in the winch, according to requirements. Alternatively, the preloading of the springs can be adjusted by the user by means of suitable means for adjusting the preload like, for example, ring nuts for compressing the springs.

More preferably, there are two or four springs, arranged diametrically opposite with respect to the longitudinal axis of the rotor body.

Preferably, the counteraction means described above comprise a pin able to rotate on the longitudinal axis and a bushing arranged coaxial to the rotary pin. The rotation axis of the rotary pin coincides with the longitudinal axis of the rotor body of the winch. The bushing is outside of the rotary pin, preferably in contact with it. The bushing is equipped with radial projections that are configured as outer arms arranged in abutment against the mobile half-pulley, on the opposite side with respect to the thrusting elements. The rotary pin and the bushing are coupled to one another by means of a cam and cam-follower coupling based on which the rotary movements of the rotary pin determine corresponding translation movements of the bushing along the longitudinal axis.

The cam and cam-follower coupling can be obtained in two equivalent ways, i.e. by arranging the cam on the pin and the cam-follower on the bushing, or vice-versa.

Preferably, the coupling foresees one or more cams, each of the inner type, obtained by forming shaped guides in the side surface of the rotary pin or in the side surface of the bushing.

Preferably, the bushing comprises one or more helical guides formed in the relative outer surface, and the rotary pin comprises corresponding one or more projections that slidably engage the guides of the bushing, or vice-versa, the rotary pin comprises one or more helical guides formed in the relative outer surface, and the bushing comprises corresponding one or more projections that engage such guides.

The projections described above are configured as cam-followers that slidably engage the inner surface of the helical guides, which are in turn configured as cams. The extension of the helical guides, which are preferably inclined with respect to a generatrix of the side surface of the pin or of the bushing, which is in turn parallel to the longitudinal axis, ensures that a rotary movement of the rotary pin transforms into a translation movement of the bushing along the longitudinal axis or into a rotary and translation movement of the bushing along the longitudinal axis. The arms of the bushing thrust the mobile half-pulley in the opposite direction to the force exerted by the thrusting means; in other words the arms of the bushing thrust the mobile half-pulley to move away from the fixed half-pulley.

For example, a clockwise rotation of the rotary pin causes a thrust of the arms of the bushing in the direction that takes the mobile half-pulley away from the fixed half-pulley (in contrast with the force exerted by the thrusting means) and, vice-versa, an anti-clockwise rotation of the rotary pin makes the thrusting of the arms of the bushing stop and, under the action of the thrusting means, the mobile half-pulley goes back into proximal position with respect to the fixed half-pulley.

Preferably, the arms of the bushing directly engage the mobile half-pulley or engage an annular element arranged in abutment against the mobile half-pulley. Irrespective of the configuration foreseen, the arms of the bushing are arranged so as to be able to exert a thrust on the mobile half-pulley in the opposite direction to the thrust exerted on the same mobile half-pulley by the springs described above.

Preferably, the arms of the bushing stay in abutment against an annular element that in turn engages the mobile half-pulley. The annular element is coaxial with the half-pulley and preferably with the rotary pin and the bushing. Should there also be a relative rotation between the arms of the bushing and the annular element, it is advisable to make the annular element from a material characterised by a low friction coefficient.

Preferably, the control element described above comprises a hand grip, or an equivalent element able to be actuated by the user, coupled with the rotary pin. For example, the control element can also be a steering wheel. The hand grip can be actuated by the user outside of the winch to increase or decrease the distance between centres between the two half-pulleys of the self-tailing device, when necessary based on the manoeuvres to be carried out.

By rotating the hand grip in the direction of activation, the user counteracts the force exerted by the springs, or by the equivalent thrusting means, on the mobile half-pulley. Since the springs are preferably preloaded, the user immediately perceives a resistance to the rotation of the hand grip. The resistance depends upon the number, the type and the preloading of the springs. When the user releases the hand grip, the springs pull the mobile half-pulley back towards the fixed half-pulley and, through the coupling of the rotary pin with the bushing, determine the rotation of the hand grip in the opposite direction to that of activation.

Preferably, the hand grip for controlling the adjustment device is arranged on top of the self-tailing device. For example, the hand grip can be arranged in place of the seat normally provided for the coupling of the handle of the winches, or else it can be coaxial to such a seat.

Preferably, the winch comprises a containment case that extends at least in part outside of the circumferential throat, and beside it, to prevent the rope from disengaging from the self-tailing device in the radial direction, i.e. perpendicularly to the longitudinal axis. In other words, the case has the function of preventing the rope accidentally coming out from the circumferential throat, at the side.

More preferably, the containment case is moveable on springs along the longitudinal axis to allow the easy insertion of the rope in the circumferential throat. In this way, the case can be momentarily lifted to allow the insertion of the rope between the two half-pulleys of the self-tailing device. Once insertion is complete, the springs take the case back into the operative position.

In a second aspect thereof, the invention concerns a method according to claim 13 for manoeuvring a rope by means of the winch described above.

In particular, the method comprises the steps of:

e) winding the rope on the rotor body of the winch and inserting it in the circumferential throat of the relative self-tailing device;

f) applying a tension on the rope setting in rotation the rotor body and the self-tailing device of the winch;

g) acting upon the adjustment device to take the mobile half-pulley away from the fixed half-pulley, increasing the section of said circumferential throat, and surging at least one section of said rope without it disengaging the self-tailing device.

Advantageously, the method just described can be actuated both on boats and on devices for lifting and lowering on a rope. The safety of the operator and the precision of the manoeuvre to release the rope are at the maximum.

Preferably the method comprises the further step of: h) interrupting step g), not acting on the adjustment device, to allow the thrusting means to pull the mobile half-pulley back towards the fixed half-pulley, tightening the rope between the two half-pulleys and preventing it from sliding.

When the user does not intervene on the hand grip of the adjustment device, the springs of the thrusting means immediately take the mobile half-pulley back into proximal position with respect to the fixed half-pulley; in this circumstance the hand grip is also thrusted into rotation in the opposite direction to that of activation.

Preferably, the movement of the mobile half-pulley between the relative proximal and distal positions is continuous. For particular applications, not described, there can be stable intermediate positions between the distal and proximal positions.

It should be understood that the basic principle of the present invention, which is based on the possibility of adjusting the distance between centres between the two half-pulleys of the self-tailing device in real time even when the rope housed in it is under tension, can also be applied to different components to winches, for example to clam cleats, pulleys, or other transmission or locking elements for nautical use.

DESCRIPTION OF THE DRAWINGS

Further characteristics and advantages of the present invention will become clearer from the following detailed description of some preferred embodiments thereof, made with reference to the attached drawings. In such drawings, FIG. 1 is a perspective view of a first embodiment of a winch according to the present invention, in a first configuration;

FIG. 2 is a partial section view of the winch shown in FIG. 1;

DETAILED DESCRIPTION OF AN EMBODIMENT

Figure 3:
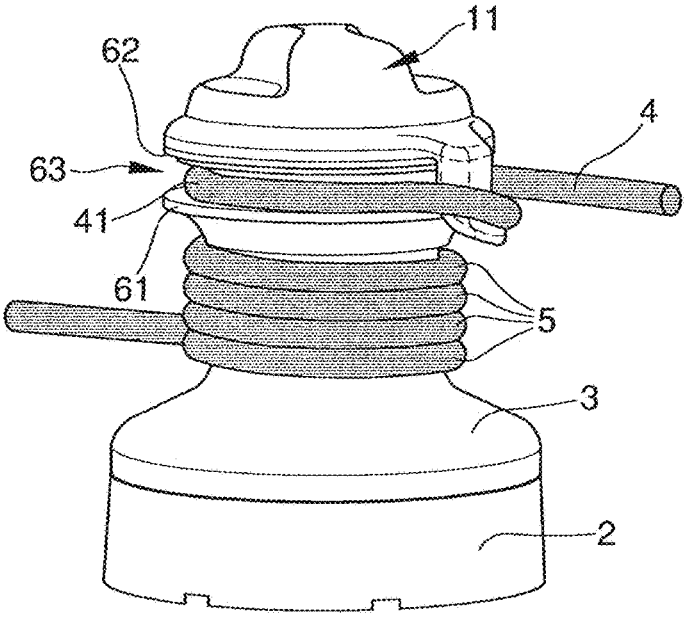
FIG. 3 is a perspective view of the winch shown in FIG. 1, in a second configuration.

FIG. 1 shows a first embodiment of a winch 1 according to the present invention, provided with a stator body 2, able to be fixed for example to the deck of a boat or to the frame of a device for lifting and lowering on a rope, and with a rotor body 3, fixedly connected to the stator body so as to be able to rotate around the longitudinal axis A-A.

Preferably, as shown in the enclosed figures, the rotor body 2 is a winding drum on which a rope, or a cable, 4 can be wound in many concentric coils or windings 5. The surface of the winding drum 2 preferably has shaped recesses formed on it, the shape of which contributes to thrusting the windings 5 of the rope 4 upwards.

On top of the winding drum 2 the winch 1 comprises a device 6 for holding back the rope 4, i.e. a self-tailing device.

FIG. 2 is an enlarged section view of the self-tailing device 6, considered along a plane containing the longitudinal rotation axis A-A of the winding drum 2.

The self-tailing device 6 comprises a lower half-pulley 61 and an upper half-pulley 62, arranged coaxial to one another and both coaxial to the winding drum 2, thus such as to rotate around the longitudinal axis A-A. The half-pulleys 61 and 62 are arranged opposing one another to define a circumferential throat 63 for receiving the last winding 41 of the rope 4.

Preferably, the self-tailing device comprises a bracket 64 for extracting the rope from the circumferential throat 63.

Preferably, as shown in FIG. 1, the inner surface 610 of the lower half-pulley 61 is knurled to maximise the grip on the rope 41.

In general, one of the two half-pulleys 61 or 62 is moveable parallel to the longitudinal axis A-A, and the other half-pulley is fixed with respect to this axis. Preferably, both of the half-pulleys 61 and 62, like in the case shown in the attached figures, rotate as a unit with the winding drum 2.

FIGS. 1-6 refer to the same embodiment of the winch 1, in which the mobile half-pulley is the lower one 61 and the fixed half-pulley is the upper one 62.

In particular, FIGS. 1 and 2 show the winch 1 in a first configuration, which corresponds to the half-pulley 61 in work position, proximal to the half-pulley 62. In this configuration the circumferential throat 63 has minimum dimensions. As an example, in FIG. 2 reference D1 indicates the distance between centres between the two half-pulleys 61 and 62.

The upper half-pulley 62 is fixed with respect to the winding drum 3 of the winch 1; the lower half-pulley 61 is fixedly connected to the winding drum 3 so as to rotate as a unit with it and at the same time be moveable parallel to the longitudinal axis A-A. This is obtained by mounting the lower half-pulley 61 sliding on vertical pins, parallel to the axis A-A, projecting at the top from the winding drum 3.

The translating movement of the lower half-pulley 61 is counteracted by a plurality of helical springs 7, preferably fitted onto the aforementioned pins and more preferably arranged diametrically opposite with respect to the axis A-A. The springs 7 are preferably preloaded in the assembly step of the winch 1 and they constantly exert a thrust that tends to take the lower half-pulley 61 back into proximal position with respect to the upper half-pulley 62 following a displacement parallel to the axis A-A. The springs 7 shown in FIG. 2 are extended (not completely since they are preloaded). As an alternative to the helical springs 7 it is possible to use sheet springs or other resilient elements, like for example rubber cylinders.

Figure 4:
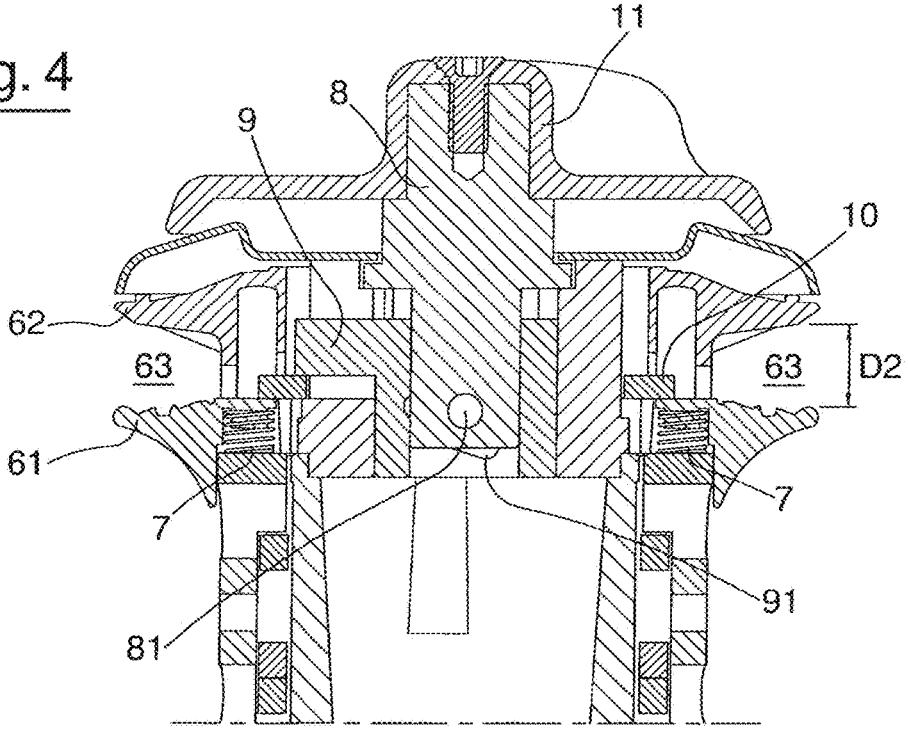
FIG. 4 is a partial section view of the winch shown in FIG. 3, in the second configuration.

FIGS. 3 and 4 show the winch 1 in a second configuration, which corresponds to the half-pulley 61 in retracted position, distal from the upper half-pulley 62. In this configuration the springs 7 are completely compressed and the circumferential throat 63 has maximum dimensions. As an example, in FIG. 4 the reference D2 indicated the distance between centres between the two half-pulleys 61 and 62.

The comparison between FIGS. 2 and 4 highlights that D1<D2, i.e. a displacement towards the winding drum 3 of the lower half-pulley 61 causes an increase in the dimensions of the circumferential throat 63.

In general, the winch 1 comprises means for counteracting the springs 7 the function of which is to control the displacement of the lower half-pulley 61 away from the upper half-pulley 62, in distal position.

In the embodiment shown in the attached figures, the counteraction means comprise an annular element 9, arranged in abutment against the upper surface of the lower half-pulley 61, on the opposite side with respect to the springs 7 and coaxial with the same half-pulley 61, a bushing 9, arranged in engagement with the annular element 9, and a pin 8 able to rotate on the longitudinal axis A-A.

The bushing 9 and the rotary pin 8 are fixedly connected by means of a cam and cam-follower coupling, for which reason the rotary movements given to the rotary pin 8 cause corresponding translation movements of the bushing 9 parallel to the longitudinal axis A-A.

The winch 1 is provided with means for adjusting the position of the lower half-pulley 61, which in the embodiment shown in FIGS. 1-4 is the mobile half-pulley. Such adjustment means can be actuated by the user in any condition of use of the winch 1 and, therefore, even when the rope 4 is under tension.

In the winch shown in the figures, the adjustment means consist of a hand grip 11 arranged on top of the self-tailing device 6, fixed to the rotary pin 8, for example with a screw, and able to be rotated by the user even with a single hand.

From the configuration shown in FIG. 2, a rotation given by the user to the rotary pin 8 by means of the hand grip 11, for example an anti-clockwise rotation, causes the opening of the same self-tailing device 6, i.e. the opening in the longitudinal direction of the circumferential throat 63, and the winch 1 goes into the configuration shown in FIG. 4.

The counteraction of the springs 7, and therefore the consequent lowered positioning of the lower half-pulley 61, lasts as long as the user keeps the hand grip 11 rotated with respect to the initial position. When the user lets go of the hand grip 11, the springs 7 autonomously thrust the lower half-pulley 61 towards the upper half-pulley 62, once again clamping the rope 41 present in the circumferential throat 63; the hand grip 11 rotates in its initial position under the thrust of the rotary pin 8, in turn set in rotation by the bushing 9 and by the annular element 10. The winch goes back into the configuration shown in FIG. 2.

Figure 5:
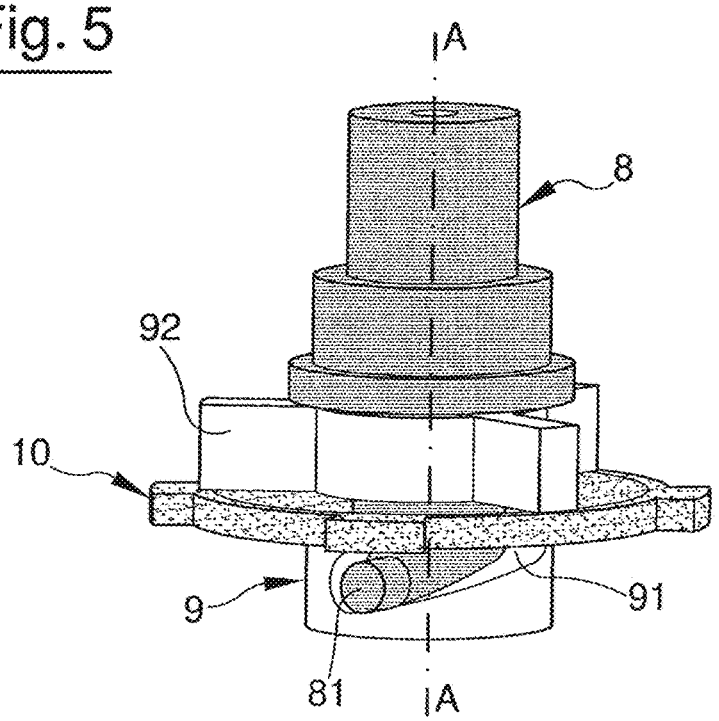
FIGS. 5 and 6 are perspective views of a detail of the winch according to the first embodiment, respectively in the first and in the second configuration.
Figure 6:
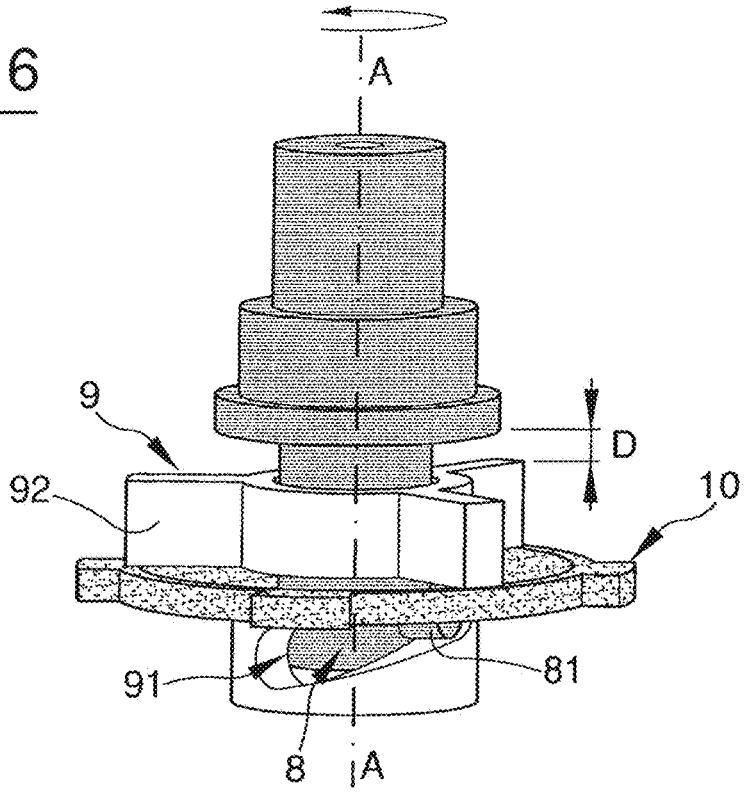

FIGS. 5 and 6 in particular show the operation of the counteraction means 8-10.

FIG. 5 shows the counteraction means 8-10 in the mutual position corresponding to the first configuration of the winch 1, with the self-tailing device 6 closed, i.e. with the lower mobile half-pulley 61 in proximal position with respect to the upper fixed half-pulley 62. The rotary pin 8 comprises one or more projections 81 slidably engaged, as cam-followers, in corresponding inner cams 91 formed through the surface of the bushing 9. The projection 81 visible in FIG. 5 is located at the lower end of the inner cam 91, in practice in a through opening that is shaped and inclined with respect to the axis A-A.

FIG. 6 shows the counteraction means 8-10 in the mutual position corresponding to the second configuration of the winch 1, with the self-tailing device 6 open, i.e. with the lower mobile half-pulley 61 in distal position with respect to the upper fixed half-pulley 62. The hand grip 11 was rotated by the user for its entire stroke and the projection 81 visible in FIG. 6 is located at the upper end of the inner cam 91; the bushing 9 is lowered with respect to the position shown in FIG. 5 by a length D proportional to the difference D2-D1.

The bushing 9 is provided with a plurality of arms 92, projecting in the radial direction, which transmit the vertical movement to the annular element 10, which in turn thrusts the lower half-pulley 61 parallel to the axis A-A.

Clearly, the user can partially rotate the hand grip 11 (thus not for the entire available stroke) to take the projection 81 into an intermediate position with respect to the positions shown in FIGS. 5 and 6 in the inner cam 91. In this way the user can effectively adjust the clamping force exerted by the half-pulleys 61 and 62 on the winding 41 present in the circumferential throat 63. In this way the user can open the self-tailing device just enough to allow the sliding of the rope 4 with respect to the two half-pulleys 61 and 62 and with respect to the winding drum 3 to precisely adjust, for example, a sail of the boat, and this without having to free the winding 41 from the circumferential throat 63.

A great advantage offered by the winch 1 is therefore the possibility of unwinding the rope 4 from the winding drum 3 in a controlled manner; by opening the self-tailing device 6 the windings 5 can be left to slip out still keeping the number of the windings 5 themselves unchanged and keeping the winding 41 in the circumferential throat of the self-tailing device 6. In this way the safety of the user is maximised during the manoeuvres to release the rope 4 under tension.

Figure 7:
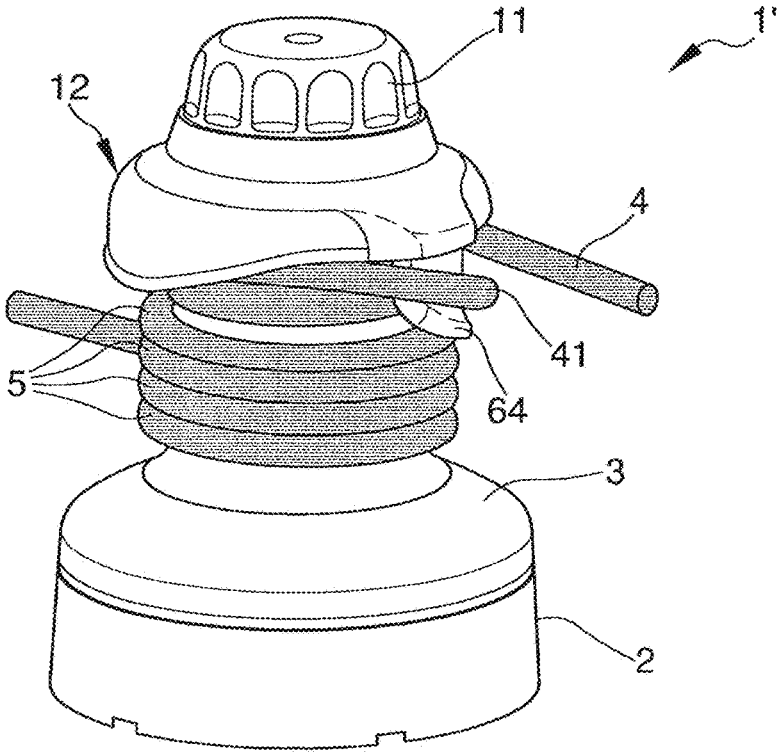
FIGS. 7 and 8 are perspective views of a second embodiment of the winch according to the present invention.
Figure 8:
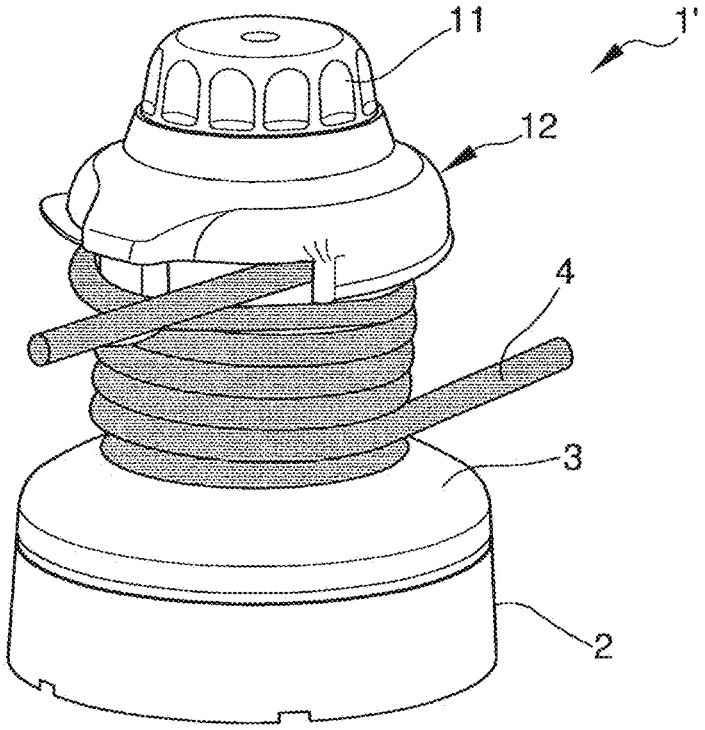

FIGS. 7 and 8 show a second embodiment of the winch 1' according to the present invention.

The winch 1' comprises, in addition to the relative self-tailing device 6', a containment case 12, mobile parallel to the longitudinal axis A-A, the function of which is to laterally close the circumferential throat 63' to avoid the rope 41 coming out.

Figure 9:
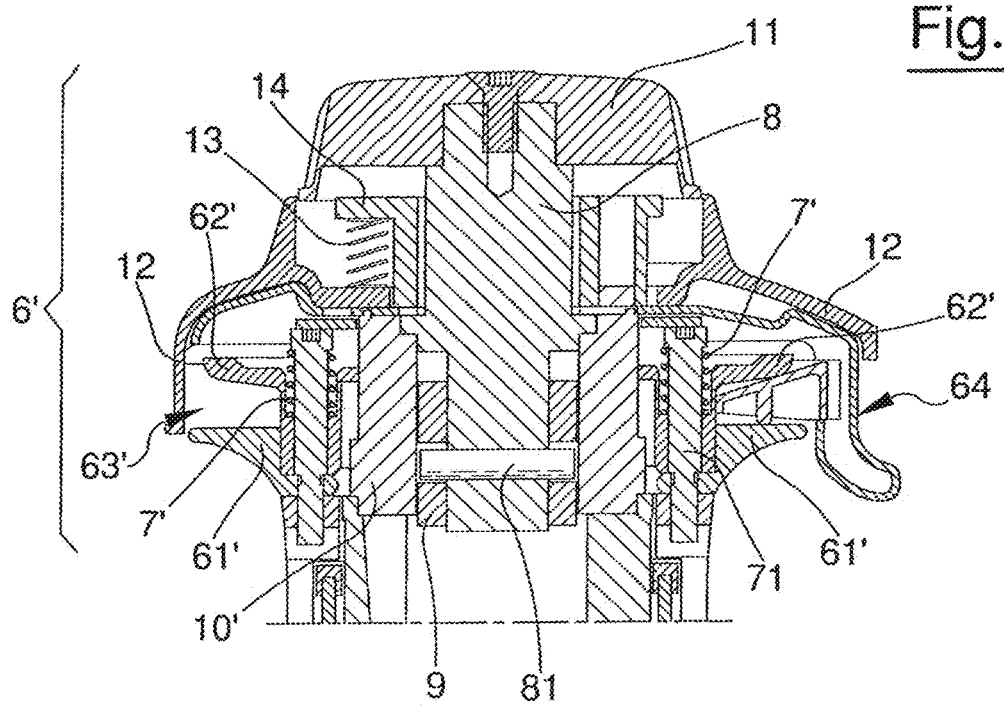
FIGS. 9-11 are partial section views of the winch shown in FIGS. 7 and 8, in different configurations of use.
Figure 10:
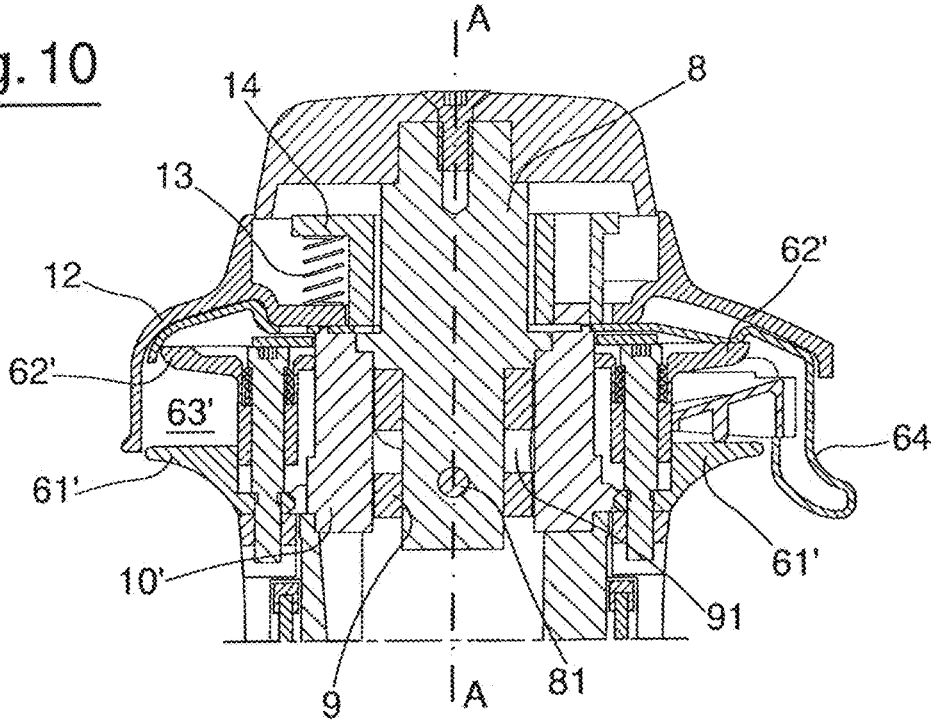
Figure 11:
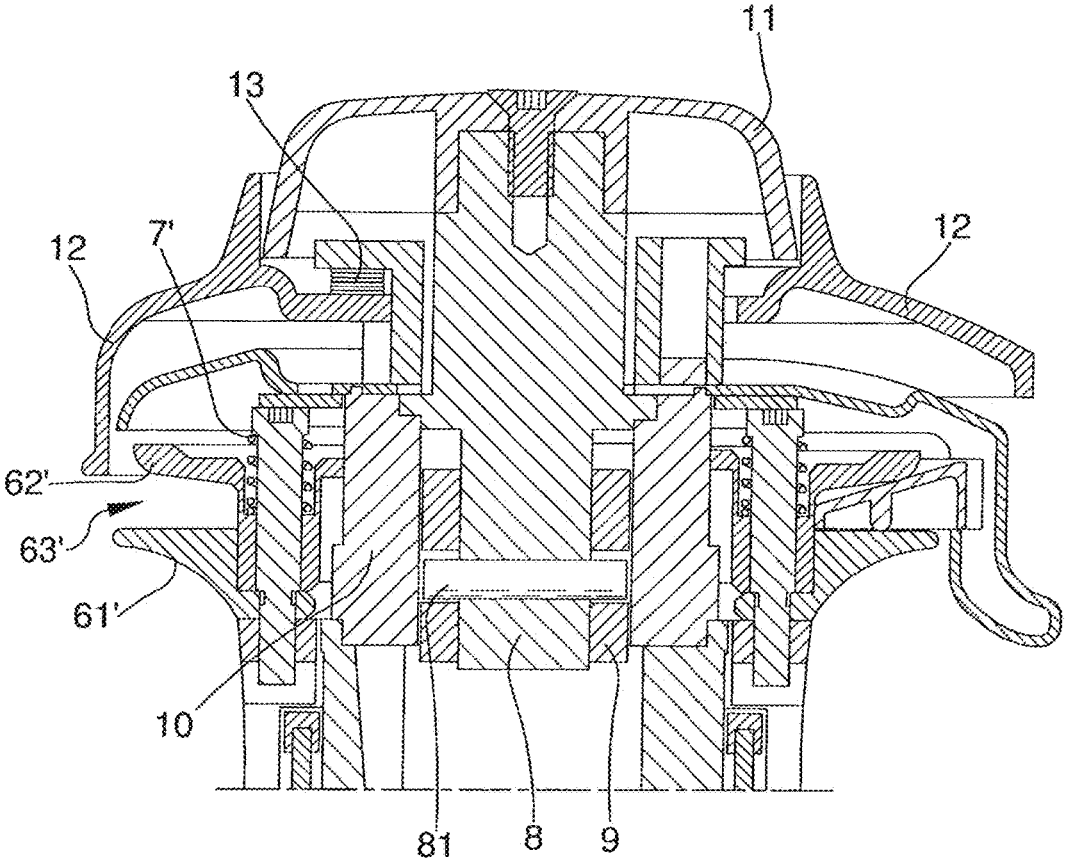

With reference to FIGS. 9-11, which show the upper part of the winch 1' in section, the containment case 12 is fixedly connected to a portion 14 of the winch, for example through pins, fixed with respect to the stator body 2. Between the containment case 12 and the fixed portion 14 there are one or more springs 13 that counteracts the translation movement of the containment case 12 along the A-A.

In normal conditions the containment case 12 laterally intercepts the circumferential throat 63' and prevents the rope from disengaging in the radial direction, perpendicular to the axis A-A. The user can intervene manually directly on the case 12 or on a suitable control member, for example the hand grip 11 for adjusting the axial position of the mobile half-pulley, to axially lift the case itself and gain access to the throat 63 for the insertion of the rope 41. For example, the hand grip 11 rotates in the clockwise direction to control the axial movement of the mobile half-pulley 62' and rotates in the anti-clockwise direction to control the axial movement of the containment case 12; alternatively, the axial movement of the containment case 12 is controlled by the hand grip 11 that rotates in the clockwise direction beyond the limit corresponding to the maximum opening of the self-tailing device 6'. In FIGS. 9 and 10 the containment case 12 is lowered and intercepts the circumferential throat 63' (the spring 13 is extended); in FIG. 11 the case 12 is raised and the throat 63' is accessible (the spring 13 is compressed).

In the winch 1' the mobile half-pulley is the upper one 62', which is able to translate parallel to the axis A-A, and the fixed half-pulley is the lower one 61', which is screwed into the winding drum 3.

In particular, FIG. 9 shows the winch 1' in its first configuration, with the self-tailing device 6' closed, i.e. with the mobile half-pulley 62' in proximal position with respect to the fixed half-pulley 61'. The springs 7' are extended.

FIG. 10 shows the winch 1' in its second configuration, obtained by rotating the hand grip 11 in the clockwise direction, with the self-tailing device 6' completely open, i.e. with the mobile half-pulley 62' in the maximum distal position with respect to the fixed half-pulley 61'. The springs 7' are compressed. By rotating the hand grip 11 by a smaller angle the mobile half-pulley 62' is brought into a distal position, intermediate between the proximal position and the maximum distal position, with respect to the fixed half-pulley 61'.

FIG. 11 shows the winch 1' in its third configuration, with the containment case 12 raised and the self-tailing device 6' open. The springs 7' and 13 are compressed.

The operation of the winch 1' is analogous to the operation of the winch 1 and shares the same advantages.

The invention claimed is:

1. A nautical winch, comprising:

a fixed stator body;

a rotor body coupled to the stator body, the rotor body being able to rotate around a longitudinal axis to wind a rope on its outer surface;

a self-tailing device comprising a lower half-pulley and an upper half-pulley, mounted coaxial to the rotor body, the half-pulleys defining therebetween, at an upper portion of an outer surface of the rotor body, a circumferential throat intended to at least partially house a winding of the rope, wherein one half-pulley is fixed with respect to the rotor body and the other half-pulley is a mobile half-pulley that is moveable parallel to the longitudinal axis to vary an axial dimension of the circumferential throat; and an adjustment device for adjusting the position of the mobile half-pulley along the longitudinal axis, independently of and without freeing the rope from the circumferential throat, while the rope is under tension and housed in the circumferential throat, by moving the mobile half-pulley continuously or intermittently through a plurality of positions ranging from a hold position proximal to the fixed half-pulley to a release position distal with respect to the fixed half-pulley, wherein in the hold position the mobile half-pulley and the fixed half-pulley are at a minimal axial distance so as to hold the rope therebetween, wherein in the release position the mobile half-pulley and the fixed half-pulley are at a maximal axial distance such that the rope is free to slide with respect to the mobile half-pulley and the fixed half-pulley; the adjustment device comprising at least one helical guide.

2. A method for manoeuvring a rope by means of a winch, the method comprising:

winding a rope on a rotor body of a winch and inserting the rope into a circumferential throat of a relative self-tailing device;

applying a tension on the rope setting a rotor body and the self-tailing device of the winch in rotation; and an adjustment device comprising at least one helical guide for adjusting a distance of a mobile half-pulley from a fixed half-pulley independently of and without freeing the rope from the circumferential throat, while the rope is under tension and housed in the circumferential throat, thereby increasing a wheelbase of the circumferential throat, and freeing at least one section of the rope without completely disengaging the rope from the self-tailing device, wherein a position of the mobile half-pulley along the longitudinal axis is adjusted by moving the mobile half-pulley continuously or intermittently through a plurality of positions ranging from a hold position proximal to the fixed half-pulley to a release position distal with respect to the fixed half-pulley, and wherein in the hold position the mobile half-pulley and the fixed half-pulley hold the rope therebetween while in the release position the rope is free to slide with respect to the mobile half-pulley and the fixed half-pulley.

3. The method according to claim 2, further comprising interrupting said adjusting, not acting upon an adjustment device, to allow thrusting means to pull back the mobile half-pulley towards the fixed half-pulley, hauling the rope between the two half-pulleys and preventing the rope from sliding.

4. The winch according to claim 1, also comprising one or more elements for thrusting the mobile half-pulley, suitable for constantly exerting a return force of the mobile half-pulley towards the fixed half-pulley, wherein the adjustment device comprises means for counteracting the force exerted by the thrusting means and an element for controlling the means for counteracting, accessible to the user outside of the winch.

5. The winch according to claim 4, wherein each of the one or more elements for thrusting the mobile half-pulley is a spring or an element made from resilient material arranged between the mobile half-pulley and a non-mobile portion of the winch along the longitudinal axis.

6. The winch according to claim 5, wherein there are two or four of said springs or elements made from resilient material, arranged diametrically opposite with respect to the longitudinal axis.

7. The winch according to claim 4, wherein the means for counteracting comprises a pin able to rotate on the longitudinal axis, and comprises a bushing arranged coaxial to the rotary pin and equipped with outer arms arranged in abutment against the mobile half-pulley on the opposite side with respect to the one or more thrusting elements, and wherein the rotary pin and the bushing are coupled to one another by means of a cam and cam-follower coupling based on which the rotary movements of the rotary pin determine corresponding translation movements of the bushing along the longitudinal axis.

8. The winch according to claim 7, wherein the bushing comprises the at least one helical guide formed in the relative outer surface, the rotary pin comprises corresponding one or more projections that slidably engage the guides, or vice-versa, the rotary pin comprises one or more helical guides formed in the relative outer surface, and the bushing comprises corresponding one or more projections that slidably engage the guides.

9. The winch according to claim 7, wherein the arms of the bushing directly engage the mobile half-pulley or engage an annular element in turn arranged in abutment against the mobile half-pulley.

10. The winch according to claim 9, wherein the annular element is made from a material having a low friction coefficient.

11. The winch according to claim 7, wherein the control element comprises a hand grip, or an equivalent element that can be actuated by the user, coupled with the rotary pin to control its rotation.

12. The winch according to claim 11, wherein the hand grip is arranged on top of said self-tailing device.

13. The winch according to claim 1, further comprising a containment case that extends at least in part outside of the circumferential throat to prevent the rope from disengaging from the self-tailing device in the radial direction, perpendicular to the longitudinal axis.

14. The winch according to claim 13, wherein the containment case is moveable on springs along the longitudinal axis to allow the easy insertion of the rope in the circumferential throat.

15. The nautical winch of claim 1, wherein the adjustment device comprises an actuating portion located on top of the self-tailing device.

16. The method of claim 2, wherein the position of the mobile half-pulley along the longitudinal axis is adjusted by acting on the mobile half-pulley from above the mobile half-pulley and the fixed half-pulley.

* * * * *